US007390287B2

(12) United States Patent
Wu

(10) Patent No.: US 7,390,287 B2
(45) Date of Patent: Jun. 24, 2008

(54) SHAKING EXERCISER

(75) Inventor: Shen Yi Wu, Taichung (TW)

(73) Assignee: Strength Master Fitness Tech Co., Ltd., Taichung (TW)

( * ) Notice: Subject to any disclaimer, the term of this patent is extended or adjusted under 35 U.S.C. 154(b) by 103 days.

(21) Appl. No.: 11/594,804

(22) Filed: Nov. 9, 2006

(65) Prior Publication Data

US 2008/0114275 A1 May 15, 2008

(51) Int. Cl.
*A63B 22/06* (2006.01)
*A63B 22/00* (2006.01)

(52) U.S. Cl. ..... 482/51; 601/49

(58) Field of Classification Search ..... 482/1, 482/51, 91–92, 8; 601/49, 108, 146, 48
See application file for complete search history.

(56) References Cited

U.S. PATENT DOCUMENTS 2,446,275 A * 8/1948 Glasin ..... 601/53
4,570,927 A * 2/1986 Petrofsky et al. ..... 482/60
4,858,598 A * 8/1989 Halpern ..... 601/105
5,046,484 A * 9/1991 Bassett et al. ..... 601/24
5,107,822 A * 4/1992 Ohashi ..... 601/23
5,301,661 A * 4/1994 Lloyd ..... 601/84
5,443,439 A * 8/1995 Ohshita ..... 601/90
6,106,490 A * 8/2000 Shaw ..... 601/49
6,659,918 B2 * 12/2003 Schiessl ..... 482/92
7,238,142 B2 * 7/2007 Kurogo et al. ..... 477/180
7,322,948 B2 * 1/2008 Talish et al. ..... 601/49

* cited by examiner

*Primary Examiner*—Steve R Crow
(74) *Attorney, Agent, or Firm*—Rosenberg, Klein & Lee

(57) ABSTRACT

A shaking exerciser includes a base having two supports between which a pivotable frame is connected. A side frame is connected to one of the two supports and has two roller members. A top pad unit is connected to a top of the pivotable frame and has an extension rod which is connected to the swing rod which extends through the support and extends between the two roller members. A driving device is connected to the base and has a link which is connected to the pivotable frame by an eccentric member so as to pivot the pivotable frame and the top pad unit. The extension rod on the top pad unit swings the swing rod so as to let the top pad unit to move in different directions.

8 Claims, 8 Drawing Sheets

SHAKING EXERCISER

FIELD OF THE INVENTION

The present invention relates to a shaking exerciser with a pad which moves up and down, and left and right.

BACKGROUND OF THE INVENTION

A conventional shaking exerciser is shown in FIG. 8 and generally includes top pad 61 and a base 62 which has two support members 63 on a top of one side thereof and two springs 64 are connected to the top of the other side of the base 62. A driving device 65 is connected on the base 62 and includes a disk with an eccentric connection point to which on end of a link 67 is pivotably connected. The other end of the link 67 is pivotably connected to an underside of the top pad 61 so that when the disk rotated by activating the driving device 65, the link 67 moves the top pad up and down. The user put his/her feet on the top pad so that the vibration of the top pad 61 transfers to the user's feet to accelerate or improve the circulation of blood of the user's body. However, the top pad 61 can only provide a simple shaking mode which is not satisfied to the users.

The present invention intends to provide a shaking exerciser that provides a shaking mode in different directions such that the users can enjoy more when using the shaking exerciser.

SUMMARY OF THE INVENTION

The present invention relates to a shaking exerciser that comprises a base with two supports and a side frame is connected to one of the two supports. Two roller members are connected to the side frame. A pivotable frame is pivotably located between the two supports and has a tube with two shafts extending from the tube in opposite directions so that the two shafts rotatably extending through the two supports. A top pad unit is connected to a top of the pivotable frame and has an extension rod extending from a center of an underside thereof. The extension rod rotatably extends through the tube and has an end member which is connected to a first end of a swing rod. A second end of the swing rod extends through the side frame and is located between and in contact with the two roller members. A driving device is connected to the base and has a link which is connected to the pivotable frame so as to pivot the pivotable frame.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
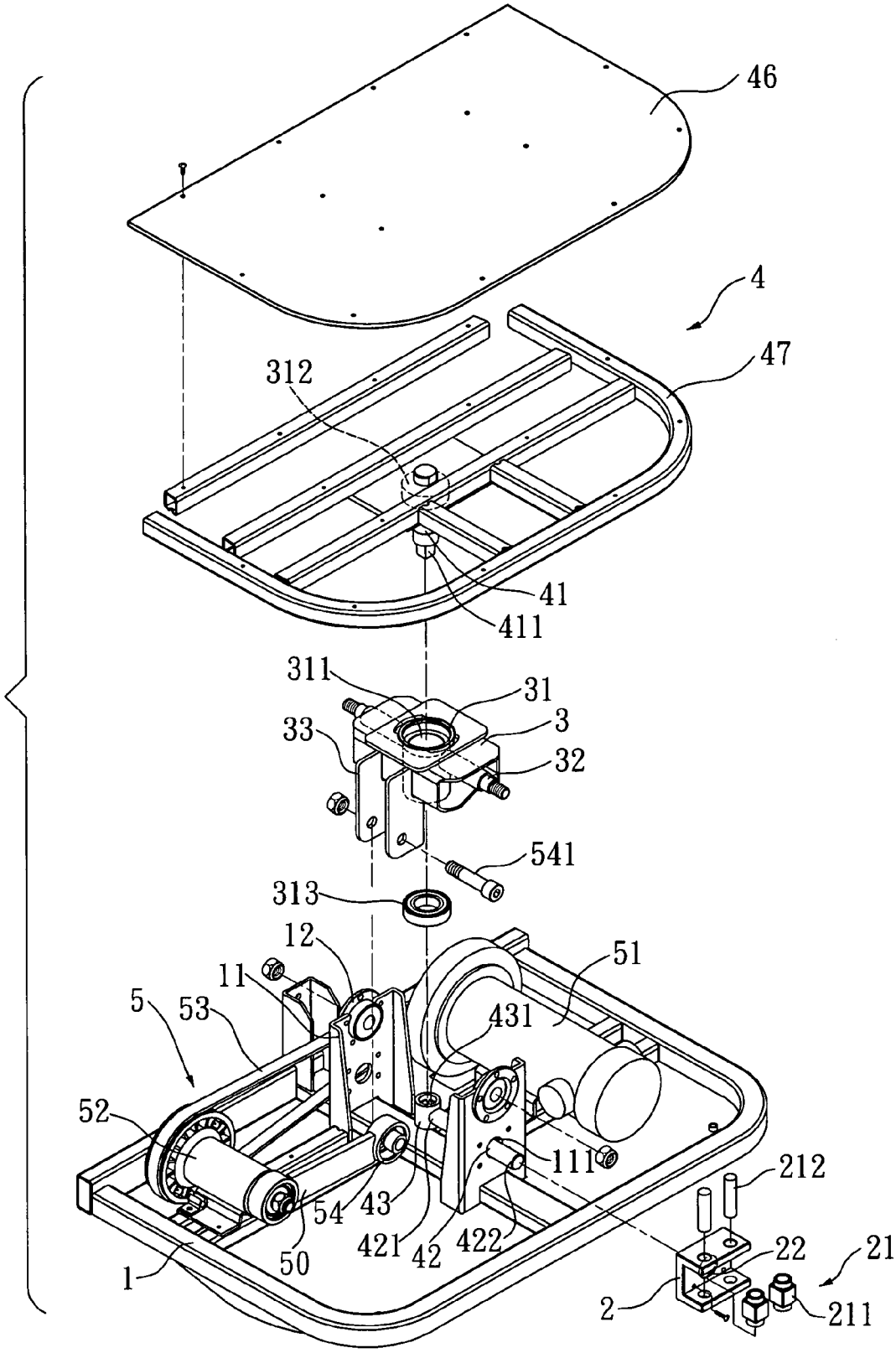
FIG. 1 is an exploded view to show the shaking exerciser of the present invention.
Figure 2:
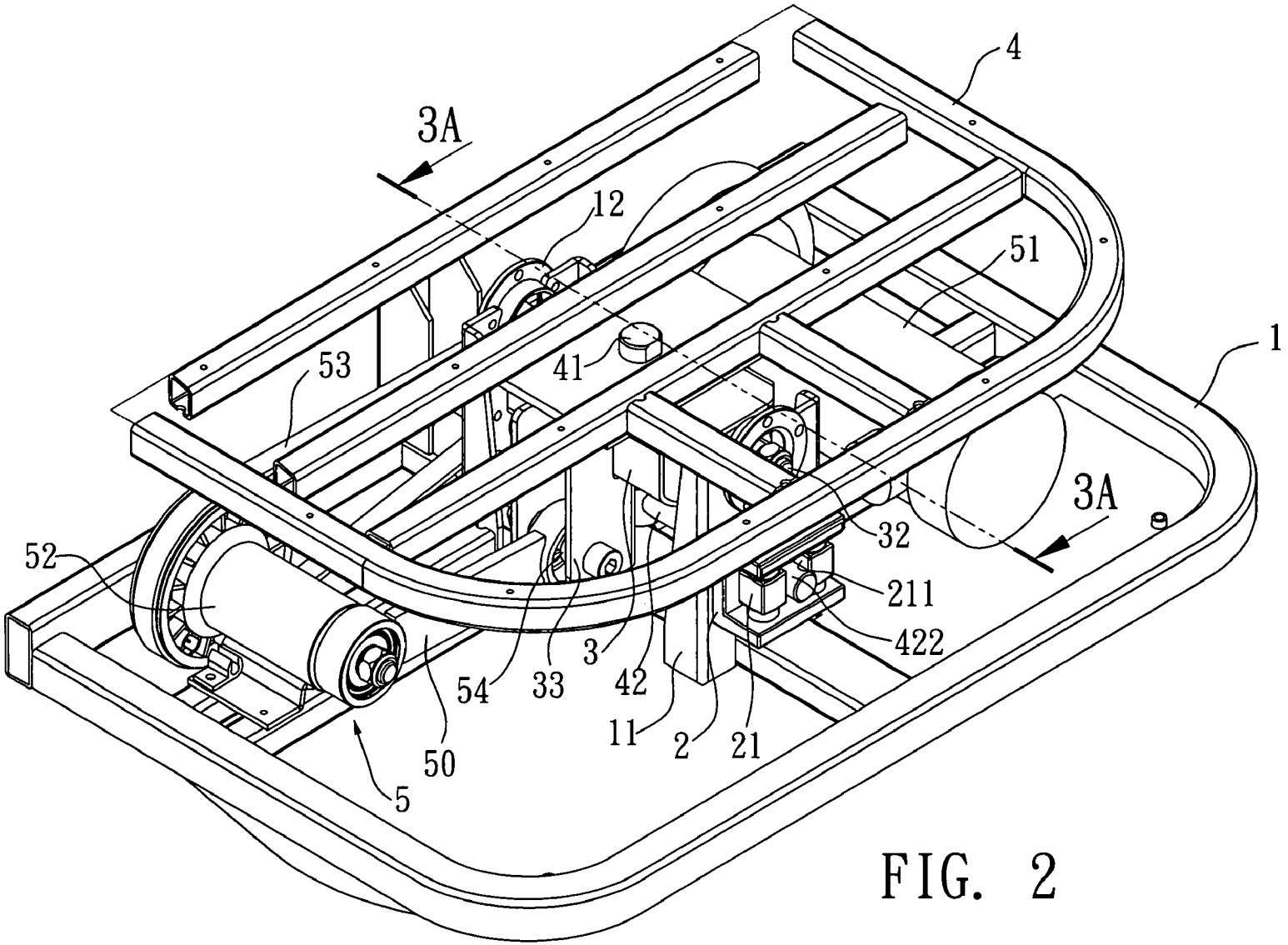
FIG. 2 is a perspective view to show the shaking exerciser of the present invention.
Figure 3:
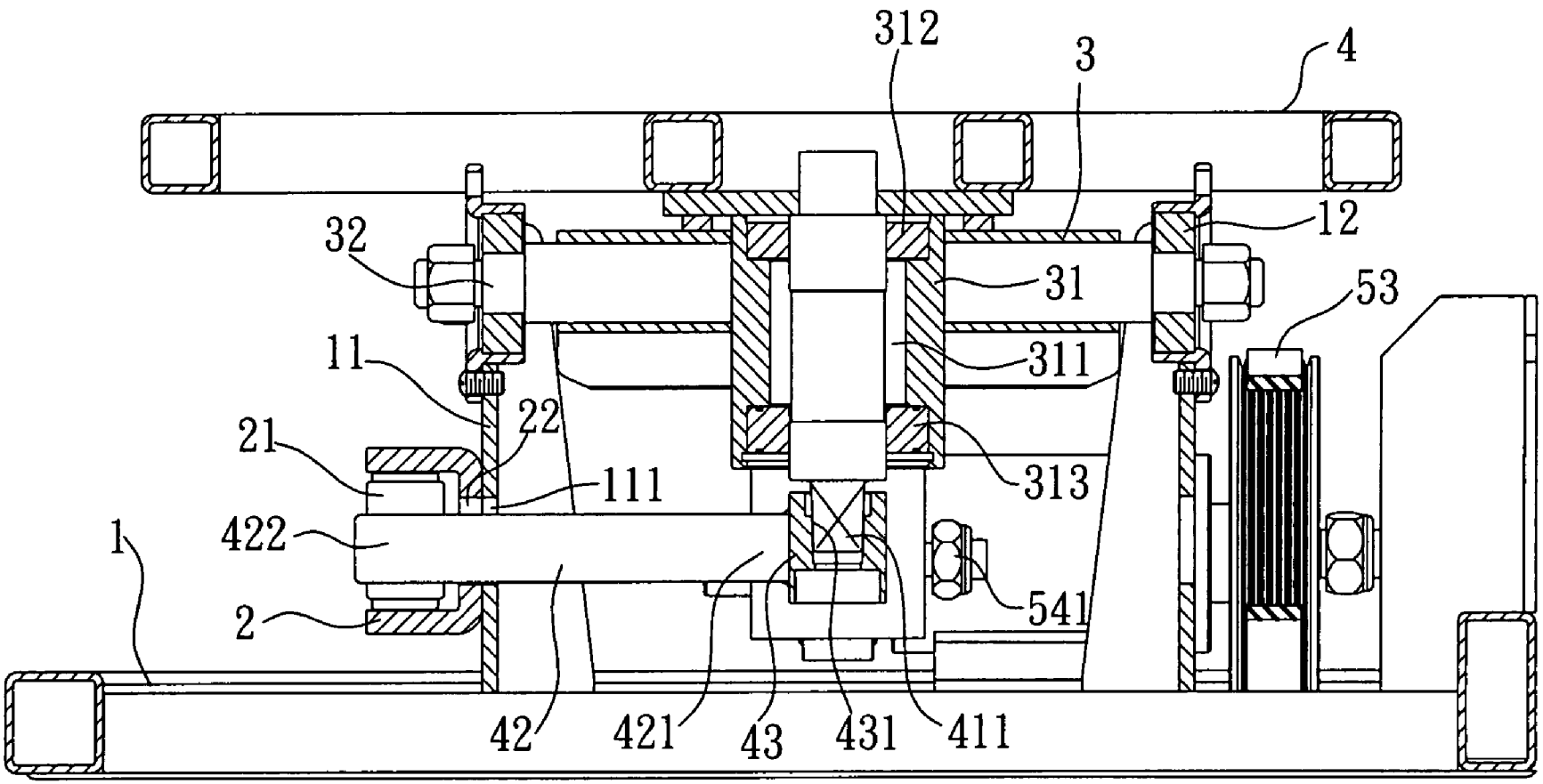
FIG. 3 is a side cross sectional view of the shaking exerciser of the present invention.
Figure 4:
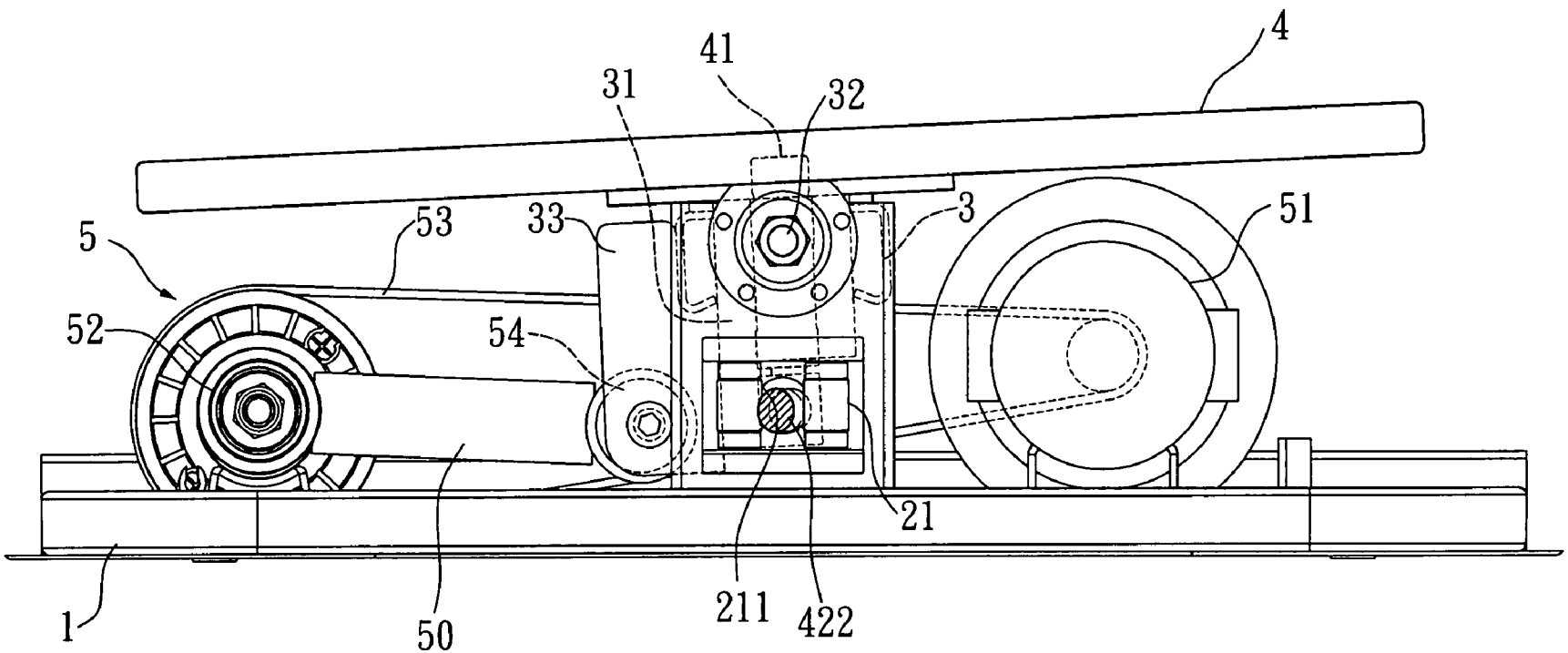
FIG. 4 shows a side view of the shaking exerciser of the present invention, wherein the swing rod is in a first position.
Figure 5:
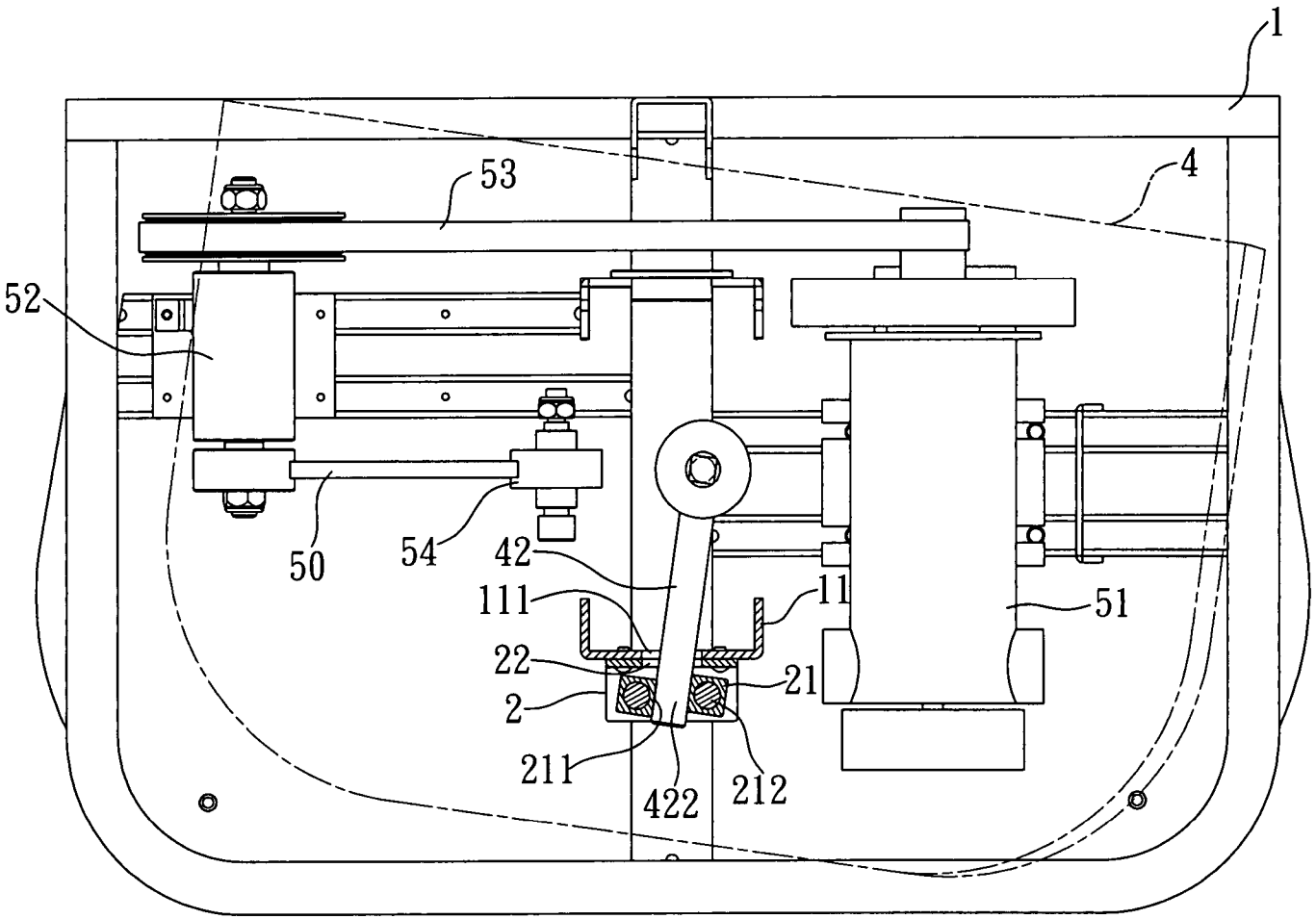
FIG. 5 shows a top view of the shaking exerciser of the present invention, wherein the swing rod is in first position.
Figure 6:
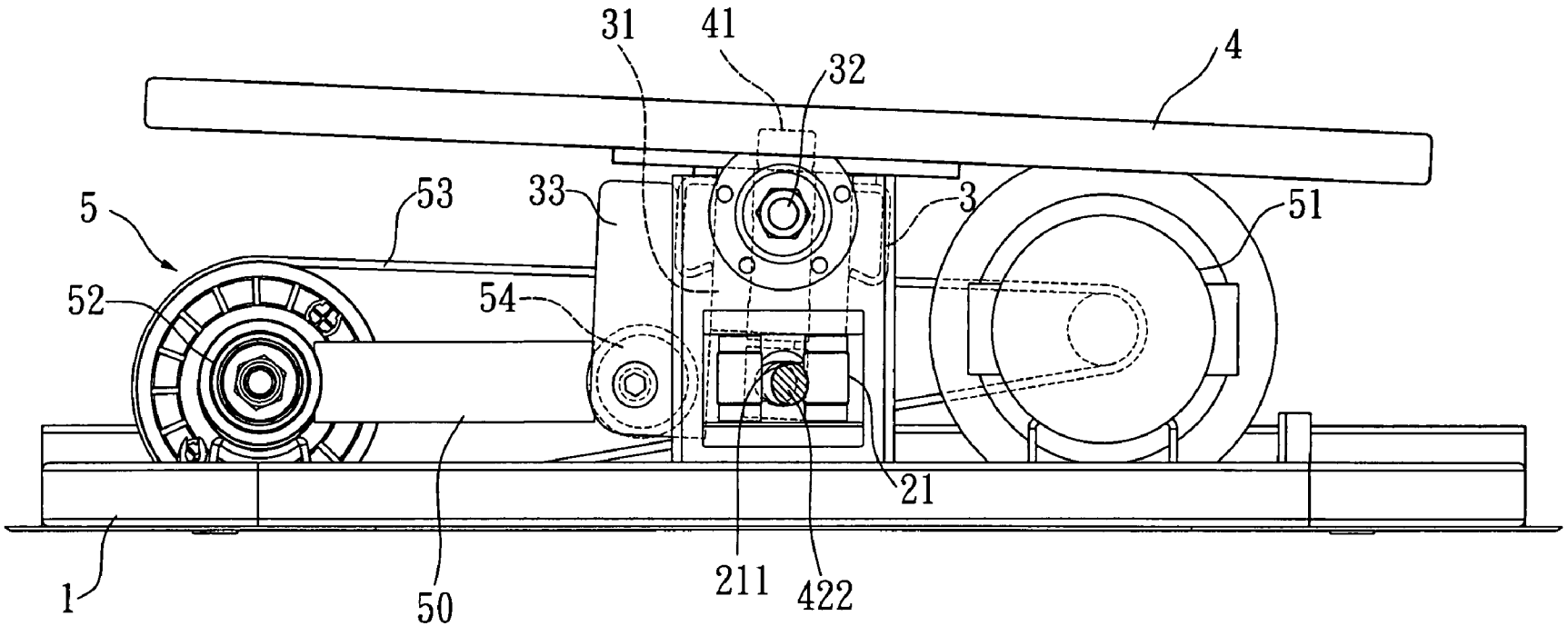
FIG. 6 shows a side view of the shaking exerciser of the present invention, wherein the swing rod is in a second position.
Figure 7:
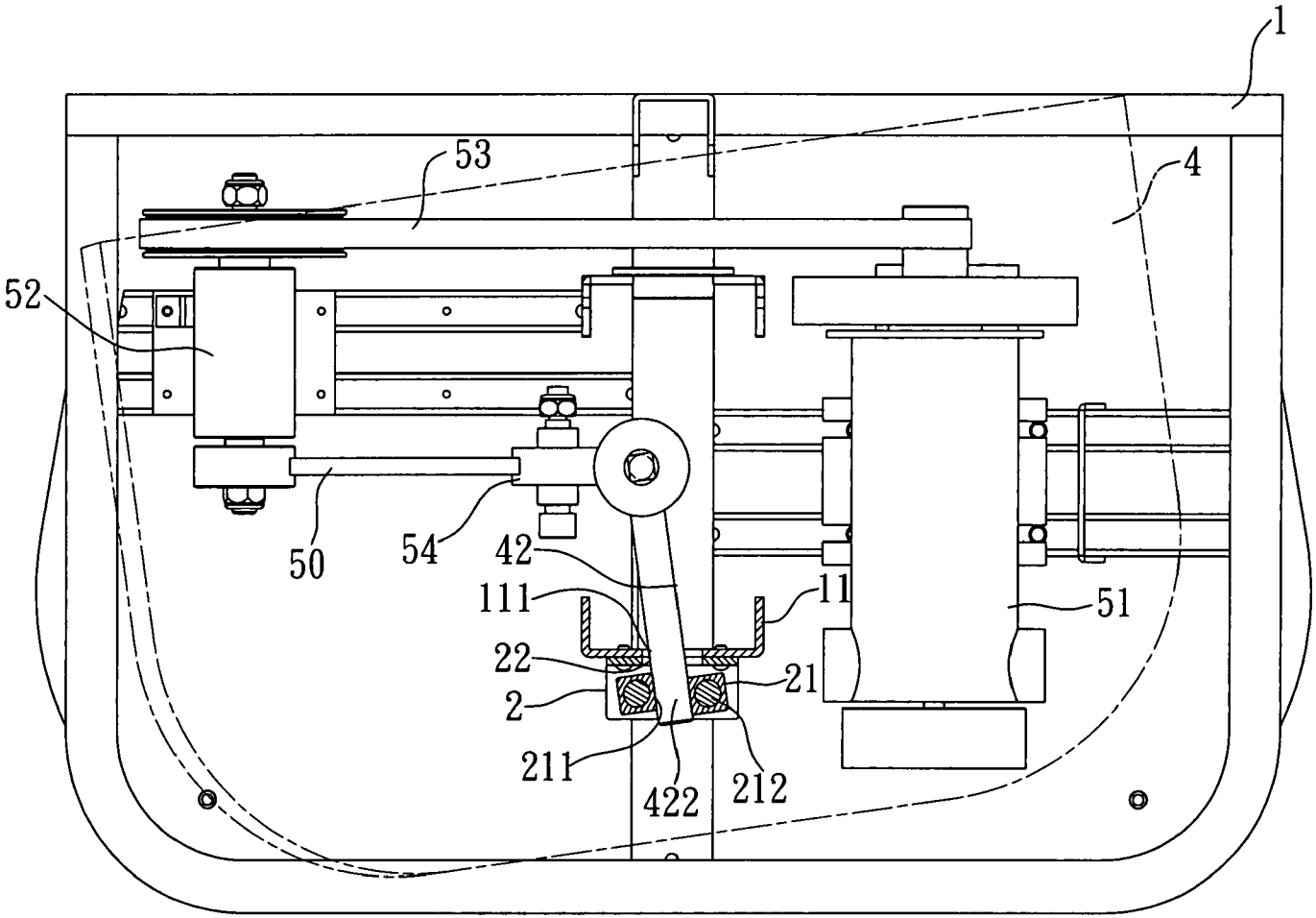
FIG. 7 shows a top view of the shaking exerciser of the present invention, wherein the swing rod is in the second position.
Figure 8:
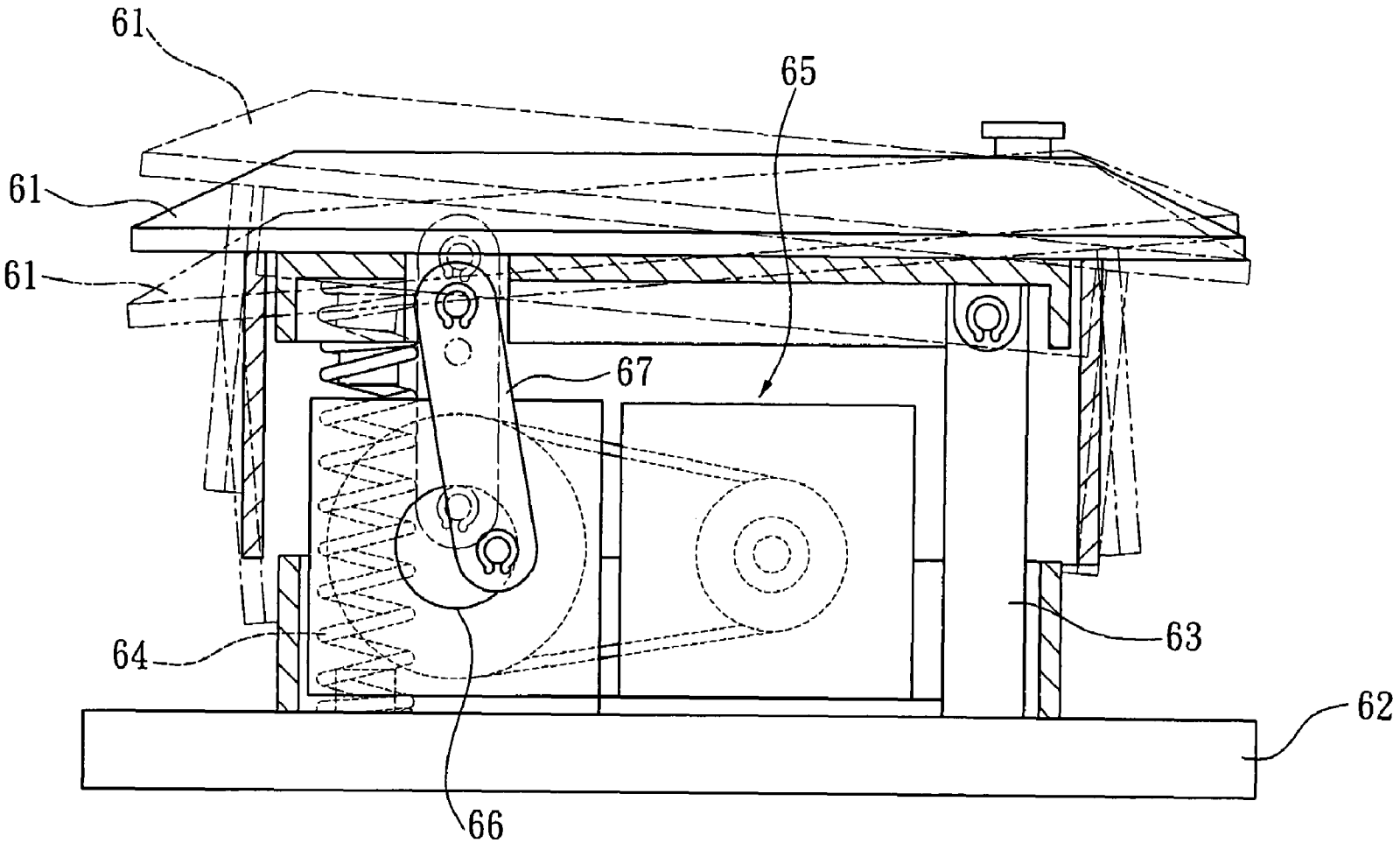
FIG. 8 PRIOR ART
FIG. 8 shows a side view of a conventional shaking exerciser.

Referring to FIGS. 1 to 3, the shaking exerciser of the present invention comprises a base 1 having two supports 11 thereon and each support 11 having a seat 12 connected thereto. A U-shaped side frame 2 is connected to an outside of one of the two supports 11 and two roller members 21 are connected between a top extension and a bottom extension of the side frame 2. Each roller member 21 has an outer periphery 211 and each of the roller members 21 has a pin 212 extending therethrough and the two pins 212 are connected between the top extension and the bottom extension so that the two roller members 21 are rotatable about the two respective pins 212.

A pivotable frame 3 is pivotably located between the two supports and has a tube 31. Two shafts 32 extend from the tube 31 in opposite directions and rotatably extend through the two seats 12. The pivotable frame 3 further includes two plates 33 which extend lower than the tube 31.

A top pad unit 4 is connected to a top of the pivotable frame 3 and includes a pad 46 and a frame 47 on which the pad 46 is fixedly connected. An extension rod 41 extends from a center of an underside of the frame 47 and rotatably extends through a passage 311 of the tube 31. Two bearings 312, 313 are received in the tube 31 and the extension rod 41 is engaged with the two bearings 312, 313. An end member 411 is connected to a distal end of the extension rod 41 and located outside of one end of the tube 3.

The support 11 that the side frame 2 is connected has a first hole 111 and the side frame 2 has a second hole 22 which is located between the two roller members 21. A swing rod 42 has a first end 421 extending through the first hole 111 and a second end of the swing rod 42 extends through the second hole 22. An inner diameter of each of the first and second holes 111, 22 is larger than an outer diameter of the swing rod 42 so that the swing rod 42 is allowed to swing in the first and second holes 111, 22. The first end 421 of swing rod 42 has a connection part 43 connected thereto which has a recess 431 so as to be engaged with the end member 411 of the extension rod 41. The second end 422 of the swing rod 42 extending through the side frame 2 is located between and in contact with the two outer peripheries 211 of the two roller members 21 so that the swing rod 42 is able to swing smoothly.

A driving device 5 is connected to the base 1 and includes a motor 51 and a gear reduction device 52. A belt 53 is connected between the motor 51 and the gear reduction device 52. The gear reduction device 52 is connected with a first end of a link 50 and a second end of the link 50 is connected with an eccentric member 54 which is pivotably between the two plates 33 of the pivotable frame 3 by a connection member 541.

As shown in FIGS. 4 to 7, when the motor 51 is activated, the link 50 is moved up and down in a curve trace so as to pivot the pivotable frame 3. The swing rod 42 is then pulled and pushed because the extension rod 41 is connected to the swing rod 42 so that first end 421 of the swing rod 42 swings back and forth between the first position in FIG. 4 and the second position in FIG. 6. Therefore, the top pad unit 4 moves in multiple directions.

The users may sit on the pad 46 or rest feet on the pad 46 and the top pad unit 4 moves according to the speed that the gear reduction device 52 outputs.

While we have shown and described the embodiment in accordance with the present invention, it should be clear to those skilled in the art that further embodiments may be made without departing from the scope of the present invention.

What is claimed is:

1. A shaking exerciser comprising:

a base (1) having two supports (11) thereon and each support (11) having a seat (12) connected thereto;

a side frame (2) connected to one of the two supports (11) and having two roller members (21) and each roller member (21) having an outer periphery (211) a swing rod (42);

a pivotable frame (3) pivotably located between the two supports and having a tube (31), two shafts (32) extending from the tube (31) in opposite directions, the two shafts (32) rotatably extending through the two seats (12);

a top pad unit (4) connected to a top of the pivotable frame (3) and having an extension rod (41) extending from a center of an underside thereof, the extension rod (41) rotatably extending through the tube (31) and having an end member (411) which is located outside of one end of the tube (31) and connected to a first end (421) of said swing rod (42), a second end (422) of the swing rod (42) extending through the side frame (2) and located between and in contact with the two outer peripheries (211) of the two roller members (21), and a driving device (5) connected to the base (1) and having a link (50) which is connected to the pivotable frame (3) so as to pivot the pivotable frame (3); wherein a user can sit or rest their feet on the pad.

2. The exerciser as claimed in claim 1, wherein the roller members (21) each have a pin (212) extending therethrough and the two pins (212) are connected between a top extension and a bottom extension of the side frame (2) so that the two roller members (21) are rotatable about the two respective pins (212).

3. The exerciser as claimed in claim 1, wherein the support (11) that the side frame (2) is connected has a first hole (111) and the side frame (2) has a second hole (22) which is located between the two roller members (21), the swing rod (42) extend through the first and second holes (111, 22), an inner diameter of each of the first and second holes (111, 22) is larger than an outer diameter of the swing rod (42).

4. The exerciser as claimed in claim 1, wherein the first end (421) of swing rod (42) has a connection part (43) connected thereto which has a recess (431) so as to be engaged with the end member (411) of the extension rod (41).

5. The exerciser as claimed in claim 1, wherein the driving device (5) includes a motor (51) and a gear reduction device (52), a belt (53) is connected between the motor (51) and the gear reduction device (52), the gear reduction device (52) is connected with a first end of the link (50) and a second end of the link (50) is connected with an eccentric member (54) which is pivotably connected to the pivotable frame (3) by a connection member (541).

6. The exerciser as claimed in claim 5, wherein the pivotable frame (3) includes two plates (33) which extend lower than the tube (31), the eccentric member (54) is pivotably connected between the two plates (33) by the connection member (541).

7. The exerciser as claimed in claim 1, wherein the tube (31) of the pivotable frame (3) includes a passage (311) through which the extension rod (41) extends, two bearings (312, 313) received in the tube (31) and the extension rod (41) is engaged with the two bearings (312, 313).

8. The exerciser as claimed in claim 1, wherein the top pad unit (4) includes a pad (46) and a frame (47) on which the pad (46) is fixedly connected.

* * * * *